United States Patent [19]

Beretta

[11] Patent Number: 4,625,444

[45] Date of Patent: Dec. 2, 1986

[54] HAIR TRIGGER FOR A RIFLE

[75] Inventor: Pier G. Beretta, Gardone V.T., Italy

[73] Assignee: Fabrica D'Armi P.Beretta S.p.A., Italy

[21] Appl. No.: 722,780

[22] Filed: Apr. 12, 1985

[30] Foreign Application Priority Data

May 30, 1984 [IT] Italy ..... 5160 A/84

[51] Int. Cl.[4] ..... F41C 19/02

[52] U.S. Cl. ..... 42/69.02; 42/69.01

[58] Field of Search ..... 42/69 A, 69 R, 69 B

[56] References Cited

U.S. PATENT DOCUMENTS 1,215,181 2/1917 Newton ..... 42/69 A

FOREIGN PATENT DOCUMENTS 2214916 10/1973 Fed. Rep. of Germany ..... 42/69 R 3301754 7/1984 Fed. Rep. of Germany ..... 42/69 A

*Primary Examiner*—Charles T. Jordan

*Assistant Examiner*—Ted L. Parr

*Attorney, Agent, or Firm*—McGlew and Tuttle

[57] ABSTRACT

A hair trigger for a rifle provided with a principal or normal trigger mechanism (A) and a hair or light trigger mechanism (B) for the firing pin (1) of the weapon, the said normal trigger mechanism (A) comprising a trigger lever (9) pivotally mounted on a pin (6) and capable of angular displacement with the trigger (5) and a trigger slide (10) which is guided vertically and designed to act together with the overlying cam profile (3-4) of a foot (2) attached to the firing pin (1), the said trigger lever (9) being displaced by a spring (11) towards the trigger slide (10) while the latter is displaced by a corresponding spring (15) towards the said foot (2), the said trigger lever (9) acting as a strut to hold the trigger slide (10) in a condition immobilizing the firing pin in the retracted cocked position, the said trigger lever (9) being capable of being displaced by the trigger slide (10) when the firing pin (1) is released to fire a projectile, wherein the light trigger mechanism (B) includes a small piston or hammer (16) which is pressed down by a compressible spring (17) and is designed to strike against a front arm (18) of the trigger (5), an auxiliary trigger lever (19) arresting the said small piston or hammer (16) in a position in which the corresponding compressible spring (17) is compressed, and an auxiliary trigger slide (20) designed to engage the said arm of the trigger (5) to immobilize the auxiliary trigger lever (19) in the condition in which it arrests the small piston or hammer (16) in the cocked position, the said small piston or hammer (16) being capable of being displaced into this position by movement of the trigger towards the small piston or hammer (16) and being capable of being released from the said position by a slight rearward movement of the trigger so that it is released from the said auxiliary trigger slide (20), the action of the said small piston or hammer on the arm (18) of the trigger causing the trigger lever (9) to move away from the trigger slide (10) in order to release the firing pin when this is held in the cocked position.

4 Claims, 7 Drawing Figures

HAIR TRIGGER FOR A RIFLE

The present invention relates to a trigger for repeating rifles fitted with a principal or normal trigger mechanism comprising a principal trigger lever which is designed to arrest a trigger slide which holds the firing pin in a cocked position and a hair or light trigger mechanism which includes a spring loaded small hammer which is designed to strike a front arm on the trigger, an auxiliary trigger lever and an auxiliary trigger slide which engages the trigger when this is moved forwards in order to cock the small hammer.

Cocked triggers, also known as hair triggers, which can be used for two different types of firing, normal firing or light firing with less force, have already been suggested in the context of firearms and in particular of ordinary repeating rifles.

In the normal firing condition, all the force required to disengage the firing pin must be applied directly to the trigger at the moment of firing. In the hair or light firing condition, the force for disengagement of the firing pin mechanism is provided mainly be a cocked spring-loaded striker which is designed to strike the trigger like a hammer as soon as it is moved to disengage it from a member which acts together with the trigger to hold back the striker in the cocked position. In this situation, the force which has to be applied to the trigger is reduced to the force which is necessary to release the trigger from the member with which it is engaged when the spring-loaded striker is in the cocked position.

There are a variety of known embodiments of such triggers which are generally designed on the basis of the characteristics of normal trigger mechanisms but these are complex and are not without disadvantages which it would be preferably to overcome.

This invention relates to a hair trigger for ordinary repeating rifles and as such is appropriate for two different conditions of trigger use, normal firing and a modified manner of firing in which less force is applied to the trigger of the firing pin release mechanism when firing a weapon of the type in question.

According to the present invention, there is provided a hair trigger for a rifle provided with a principal or normal trigger mechanism and a hair or light trigger mechanism for the firing pin of the weapon, the said normal trigger mechanism comprising a trigger lever pivotally mounted on a pin and capable of angular displacement with the trigger and a trigger slide which is guided vertically and designed to act together with the overlying cam profile of a foot attached to the firing pin, the said trigger lever being displaced by a spring towards the trigger slide while the latter is displaced by a corresponding spring towards the said foot, the said trigger lever acting as a strut to hold the trigger slide in a condition immobilising the firing pin in the retracted cocked position, the said trigger lever being capable of being displaced by the trigger slide when the firing pin is released to fire a projectile, wherein the light trigger mechanism includes a small piston or hammer which is pressed down by a compressible spring and is designed to strike against a front arm of the trigger, an auxiliary trigger lever arresting the said small piston or hammer in a position in which the corresponding compressible spring is compressed, and an auxiliary trigger slide designed to engage the said arm of the trigger to immobilise the auxiliary trigger lever in the condition in which it arrests the small piston or hammer in the cocked position, the said small piston or hammer being capable of being displaced into this position by movement of the trigger towards the small piston or hammer and being capable of being released from the said position by a slight rearward movement of the trigger so that it is released from the said auxiliary trigger slide, the action of the said small piston or hammer on the arm of the trigger causing the trigger lever to move away from the trigger slide in order to release the firing pin when this is held in the cocked position.

The present invention will be further illustrated, by way of example, with reference to the accompanying drawings, in which.

Figure 6:
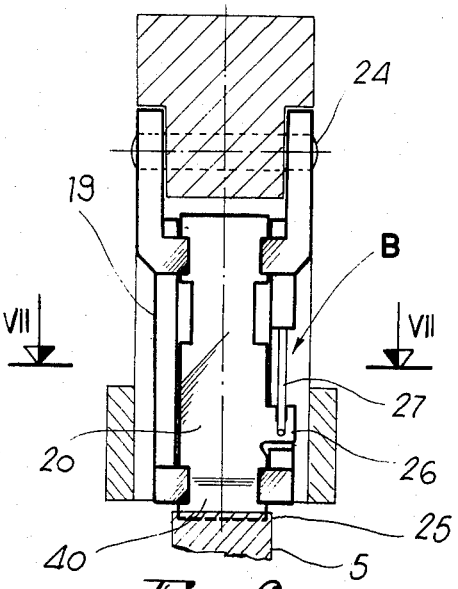
Figure 3:
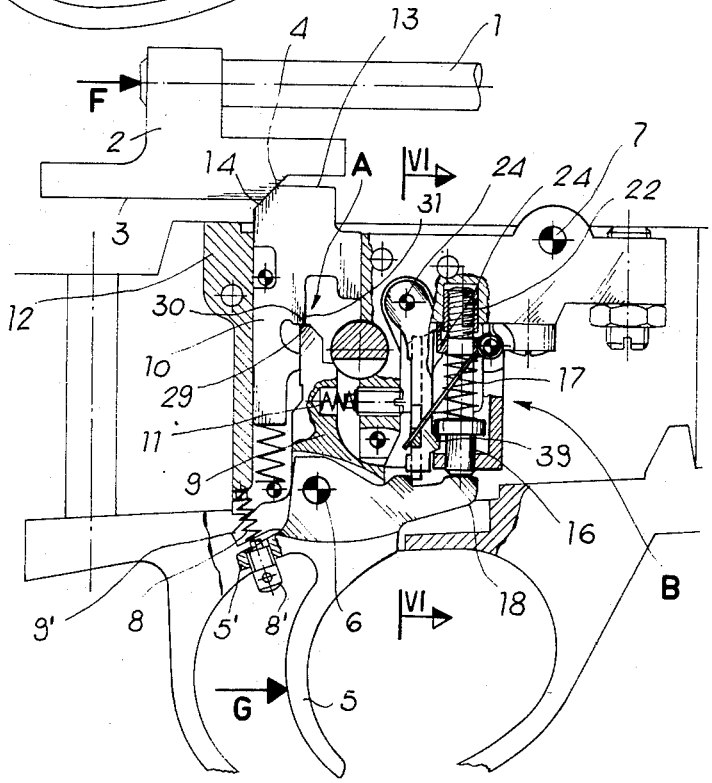
FIG. 3 is a similar side view as in FIG. 2 but with the mechanism in the cocked position for light release of the firing pin.
Figure 5:
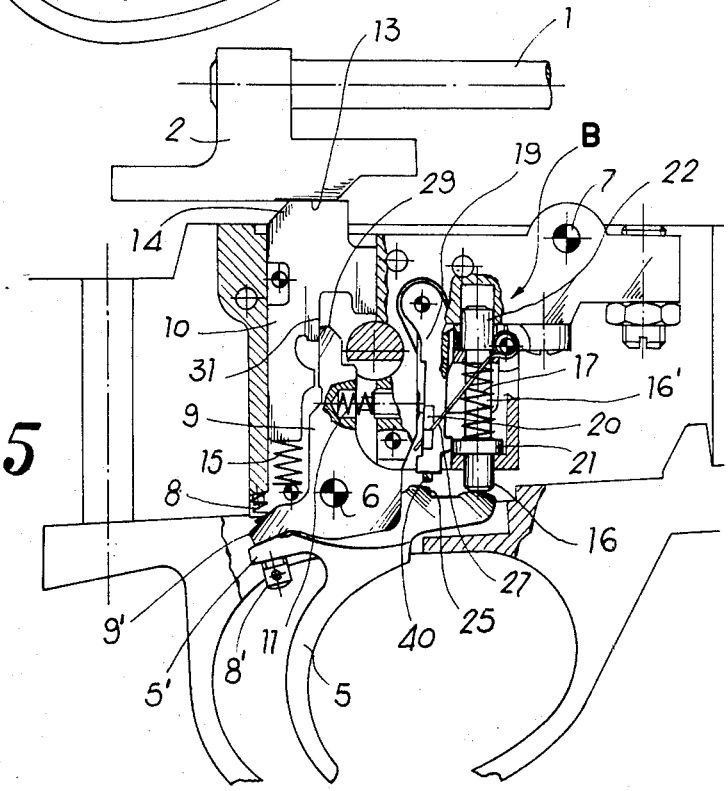

FIG. 5 again is a side view and in partial cross-section showing the condition of the trigger after the firing pin has been released by normal firing or by light firing;

FIG. 6 is a cross-section taken along the line VI—VI of FIG. 3; and

Figure 1:
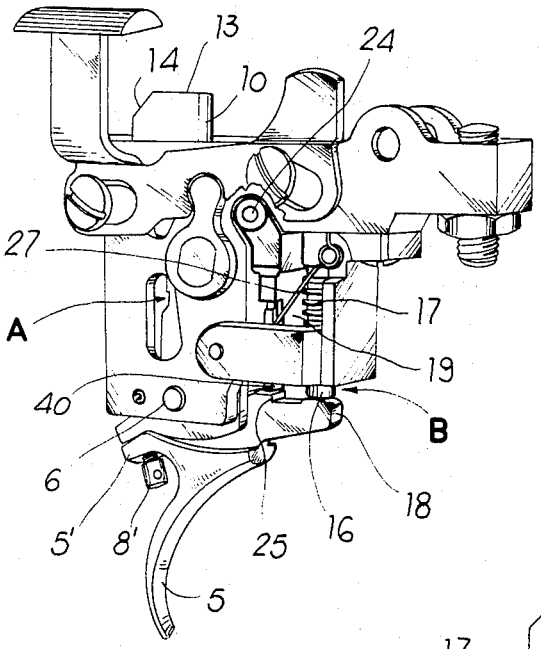
FIG. 1 is a perspective view of the trigger and the corresponding normal and light trigger mechanisms.
Figure 7:
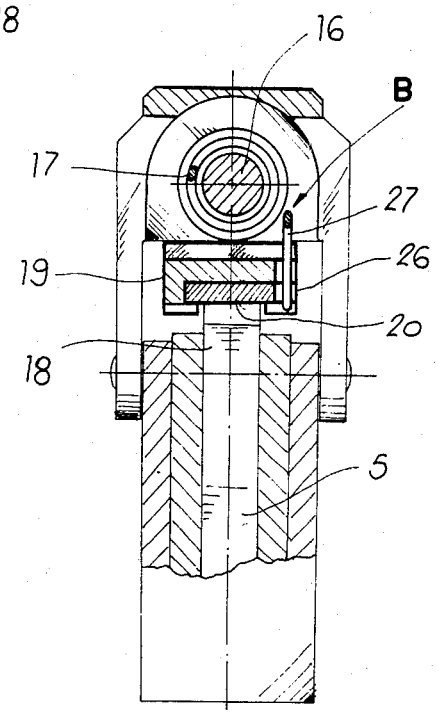

FIG. 7 is a section taken along the line VII—VII of FIG. 6.

A rifle, spring-loaded in the direction of arrow F by a spring which is not shown, has a firing pin 1 and is provided in a known manner with a foot 2 having on its underside a cam profile defined by a horizontal face 3 followed by an inclined plane or bevel 4.

The foot 2, and more particularly its cam profile 3, 4, acts together with a principal or normal trigger mechanism A which ends in a trigger 5 which is also associated with a light trigger mechanism so as to bring about the two abovementioned conditions of normal firing and light firing.

In greater detail, the trigger 5 is pivoted on a pin 6 in supporting member 12 and is spring loaded by means of a recovery spring 8 acting on a tang 5' on the trigger itself.

Principal trigger mechanism A includes a trigger lever 9 acting in association with a trigger 5 and a trigger slide 10 which acts on one side with the said firing lever 9 and above with the cam profile 3, 4 of foot 2 of firing pin 1. Firing lever 9 is hinged and pivots or rocks on the pin 6 of trigger 5 and is provided at its rear with an arm 9' which overlaps the tang 5' of trigger 5. Trigger lever 9 has one end 29 which acts as a strut and is designed to engage a shoulder 30 made on face 31 of trigger slide 10. Trigger lever 9 is also spring-loaded by a spring 11 which is designed to move the lever and hold the said lever normally against side 31 of the trigger slide so that end 29 of trigger lever 9 and shoulder 30 of trigger slide 10 engage each other when firing pin 1 is moved backwards into the cocked position and is then ready to fire a round. Also when in this position arm 9' of trigger lever 9 rests against the tang 5' of trigger 5 as in FIG. 2.

Trigger slide 10 is then guided vertically in a supporting member 12 attached to the weapon by pin 7 and has a top profile consisting of a bevel 14 and a horizontal face 13 which are designed to act in conjunction with the bevel or inclined plane 4 and the horizontal face 3 of the cam profile of foot 2 which is displaced with the firing pin 1. Trigger slide 10 is spring-loaded at the base by means of a spring 15 which ensures that the upper profile 13, 14 of the slide is always in contact with the cam profile 3, 4 of the foot of firing pin 1 for the purpose which will be described below.

In turn, hair trigger mechanism B comprises a small piston or hammer 16 which is spring-loaded by a compression spring 17 and is designed to strike a front arm 18 of trigger 5, an auxiliary trigger lever 19 which holds the said small piston or hammer 16 in a position in which the corresponding spring is compressed, and an auxiliary trigger slide 20 which acts in conjunction with the said front arm 18 of trigger 5 to immobilise the said auxiliary trigger lever 19 in the condition in which it holds the small piston or hammer 16 in a cocked position.

The said small piston or hammer 16 has a shank 16' which is guided vertically within the body of support 12 and incorporates an intermediate collar 21 and at the top of threaded portion onto which an adjustment bush 22 is screwed. Spring 17 or the said small piston or hammer 16 is fitted between intermediate collar 21 and a cap 23 which is guided on shank 16' and is designed to rest against body 12 under pressure from spring 17 and act as a stop for threaded adjustment bush 22.

Auxiliary trigger lever 19 is pivoted in the manner of a pendulum on supporting member 12 by means of a pin 24 and has an arresting catch 39 facing small piston or hammer 16 which is designed to engage intermediate collar 21 to hold the said small piston or hammer 16 with the corresponding spring 17 in a compressed condition.

Auxiliary trigger slide 20 is mounted and guided vertically on auxiliary trigger lever 19, see FIGS. 6 and 7, and has at its lower end an end member 40 which is designed to engage a shoulder 25 made in the upper face of front arm 18 of trigger 5. At the side, auxiliary trigger slide 20 is provided with a step 26 against which rests a spring 27 which acts so as to hold down auxiliary slide 20 and to hold auxiliary lever 19 against collar 21 of small piston or hammer 16.

Thus auxiliary slide 20 moves together with auxiliary lever 19 about pin 24 and is also free to move longitudinally or vertically independently of said auxiliary lever no matter what its position may be.

Figure 2:
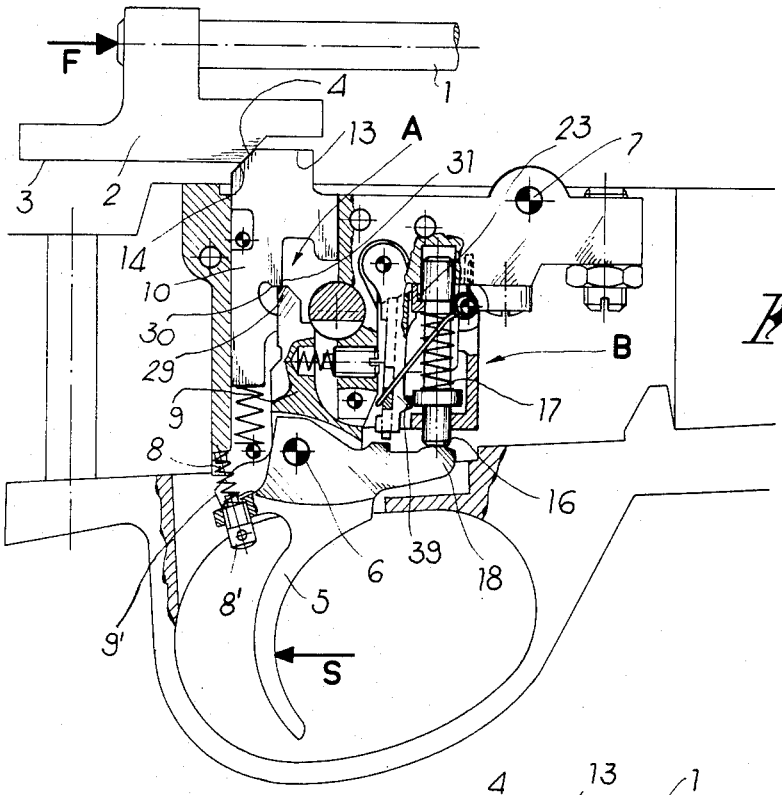
FIG. 2 is a side view of the mechanism for normal release of the firing pin in partial cross-section.

Hair trigger mechaism B remains inactive and without effect as long as trigger 5 is not displaced angularly forwards in the direction of arrow G in FIG. 3 beyond its normal position of rest defined on the one side by the force of the corresponding recovery spring 8 and on the other side by the contact between anterior appendage or arm 18 of the trigger and small piston or hammer 16, see FIG. 2, the force of recovery spring 8 being less than that of spring 17 of the said small piston or hammer 16.

In practice thrust F against firing pin 1 is transmitted via the contact between the bevels or inclined planes 4, 14 to trigger slide 10 with a component force which displaces the said slide downwards in opposition to spring 15. When trigger 5 is in the rest position downward displacement of trigger slide 10 is restricted by the end member 29 of trigger lever 9 which acts as a strut and which under pressure from spring 11 presses against side 31 of trigger slide 10 to intercept and engage shoulder 30 of the said slide 10. In a similar condition, see FIGS. 2 and 4, trigger slide 10 is immobilised in an intermediate position between foot 2 of firing pin 1 and trigger lever 9 and also holds the firing pin in a cocked position through the juxtaposition of bevels or inclined planes 4, 14.

In order to release firing pin 1 when the weapon is fired, it is then necessary to act on trigger 5 in the direction of arrow S in FIG. 2 to move trigger lever 9 about point 6 via its tang 5' and to move its end member 29 away from the shoulder on trigger slide 10. The latter, being no longer supported by end member 29 of trigger lever 9 is pushed downwards by the component of the force due to the contact between bevels or inclined planes 4, 14 allowing the firing pin to move forward and strike, see FIG. 5. In this situation, the force which must be applied manually to trigger 5 in order to release the firing pin is regarded as being "normal" and is the force required to overcome the force of trigger recovery spring 8 and spring 11 of trigger lever 9, in addition to the contact force and friction between shoulder 30 of trigger slide 10 and end member 29 of the said trigger lever 9.

When, on the other hand, it is wished to release the firing pin by applying less force to trigger 5 for greater sensitivity and accuracy from the weapon light or hair trigger mechanism B must be brought into play and cocked. This is achieved in the manner mentioned above by moving trigger 5 forward in the direction of arrow G in FIG. 3 after firing pin 1 has been drawn back into cocked position and secured in such position through the interaction between the lever and principal trigger slide 9,10. The forward movement of trigger 5 causes the small piston or hammer 16 to move upwards through the action of front arm 18 of the trigger so compressing corresponding spring 17. The small piston or hammer is immobilised in the cocked position by auxiliary trigger lever 19 which under pressure from spring 27 engages its arresting catch 39 beneath intermediate collar 21 of the small piston or hammer, as in FIGS. 3 and 4. Auxiliary trigger slide 20 is also stressed by spring 27, engages its end member 40 with shoulder 25 on front arm 18 of trigger 5 which prevents arresting catch 39 from releasing intermediate collar 21 from small piston or hammer 16 and at the same time secures trigger 5 in the intermediate position in which its tang 5' is at a slight distance from the overlying arm of principal trigger lever 9, see FIG. 3, spring 8 also contributes to holding trigger 5 in this position.

Figure 4:
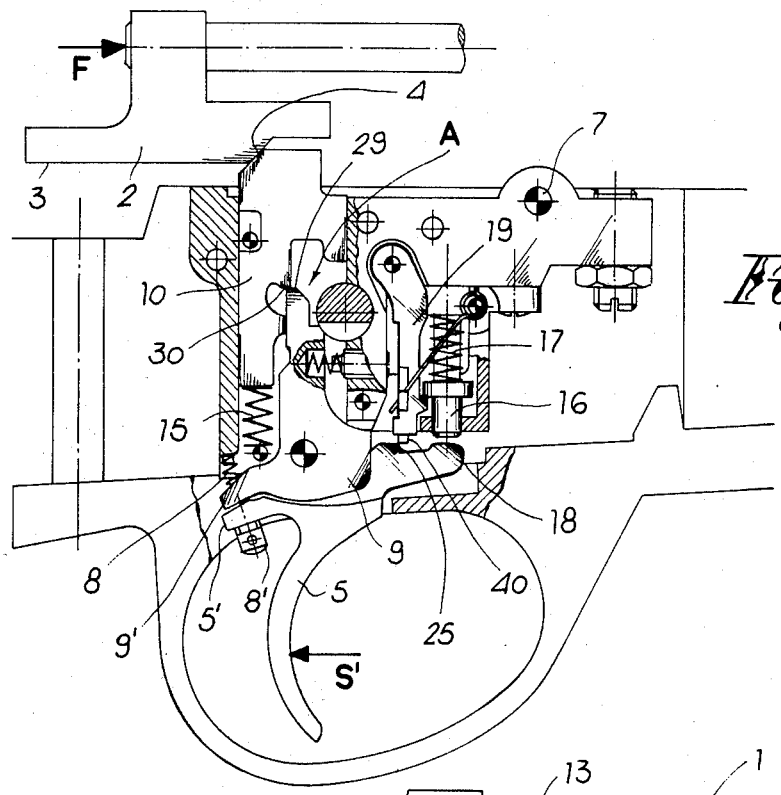
FIG. 4 is a further side view of the mechanism in a position immediately prior to activation of the hair trigger.

In this situation then, the force which must be applied by hand to trigger 5 in the direction of arrow S', see FIG. 4 of the drawing, in order to release firing pin 1 is less and is limited to the force required to overcome the contact force between end member 40 of auxiliary trigger slide 20 and shoulder 25 on the front arm of trigger 5 together with the force required to overcome the force of spring 8 which can be adjusted by screwing or unscrewing cap 8' located on the tang 5' of trigger 5.

When auxiliary trigger slide 20 has been released from shoulder 25, pendulum trigger lever 19 moves backwards pushed by the small piston or hammer releasing the latter which, driven by compressed spring 17, moves sharply downwards striking the front arm 18 of trigger 5. The latter then moves so that its tang 5' strikes arm 9' of principal trigger lever 9 which rotates to move away from principal trigger slide 10 and thus releases the firing pin to strike.

Essentially therefore, in the hair or light firing condition, the effective force releasing the firing pin is chiefly provided by the kinetic energy of the small piston or hammer or compressed spring which is transmitted to the principal trigger lever by the trigger.

I claim:

1. A hair trigger for a rifle provided with a principal or normal trigger mechanism and a hair or light trigger mechanism for the firing pin of the weapon, the said normal trigger mechanism comprising a trigger lever pivotally mounted on a pin and capable of angular displacement with a trigger and a trigger slide which is guided vertically and designed to act together with an overlying cam profile of a foot attached to the firing pin, the said trigger lever being displaced by a spring towards the trigger slide while the latter is displaced by a corresponding spring towards the said foot, the said trigger lever acting as a strut to hold the trigger slide in a condition immobilising the firing pin in the retracted cocked position, the said trigger lever being capable of being displaced by the trigger slide when the firing pin is released to fire a projectile, wherein the light trigger mechanism includes a small piston or hammer which is pressed down by a compressible spring and is designed to strike against a front arm of the trigger, an auxiliary trigger lever arresting the said small piston or hammer in a position in which the corresponding compressible spring is compressed, and an auxiliary trigger slide designed to engage the said arm of the trigger to immobilise the auxiliary trigger lever in the condition in which it arrests the small piston or hammer in the cocked position, the said small piston or hammer being capable of being displaced into this position by movement of the trigger towards the small piston or hammer and being capable of being released from the said position by a slight rearward movement of the trigger so that it is released from the said auxiliary trigger slide, the action of the said small piston or hammer on the arm of the trigger causing the trigger lever to move away from the trigger slide in order to release the firing pin when this is held in the cocked position.

2. A hair trigger according to claim 1, in which the said small piston or hammer stressed by a compressible spring is guided vertically in a supporting member and is fitted with an intermediate collar with which it engages an arresting catch provided in the auxiliary trigger lever to secure the small piston or hammer in the position in which the said spring is compressed, the said spring being fitted between the said collar and a threaded adjustment bush screwed onto the top of the shank of the small piston or hammer.

3. A hair trigger as claimed in claim 1 or 2, in which the said auxiliary trigger lever is pivoted in the maner of a pendulum on a supporting member, in which the said auxiliary trigger slide is mounted and guided vertically along the said auxiliary trigger lever and has at its bottom end an end member which is designed to engage an arresting shoulder made in the arm of the trigger, and in which the said auxiliary trigger lever can be displaced towards the said small piston or hammer and the said auxiliary trigger slide can be displaced towards the arm of the said trigger by a single spring pressing against a lateral step in the said auxiliary trigger slide.

4. A hair trigger as claimed in claim 3, in which a stop cap member which is designed to rest against the body guiding the shank of the small hammer is fitted between the compressible spring and the adjustment bush.

* * * * *